United States Patent [19]

Carroll et al.

[11] 4,257,168

[45] Mar. 24, 1981

[54] METHOD OF AND APPARATUS FOR DRYING PARTICULATE MATERIAL

[75] Inventors: John Carroll; Harry Dearing; Keith Swain; Warren Naughton, all of Mayfield, Australia

[73] Assignee: Blue Metal and Gravel Pty. Ltd., New South Wales, Australia

[21] Appl. No.: 8,597

[22] Filed: Feb. 1, 1979

[30] Foreign Application Priority Data

Feb. 7, 1978 [AU] Australia ..... PD3284

[51] Int. Cl.[3] ..... F26B 7/00

[52] U.S. Cl. ..... 34/17; 34/60; 34/164; 34/179; 209/11; 209/238; 219/201

[58] Field of Search ..... 34/1, 17, 60, 61, 174, 34/179, 164; 209/11, 238; 219/201

[56] References Cited

U.S. PATENT DOCUMENTS

| | | | |
|---|---|---|---|
| 693,455 | 2/1902 | Stanley | 209/238 |
| 1,501,047 | 7/1924 | Hall | 209/238 |
| 2,984,357 | 5/1961 | Kufferath | 209/238 |

*Primary Examiner*—John J. Camby

*Attorney, Agent, or Firm*—Fulwider, Patton, Rieber, Lee & Utecht

[57] ABSTRACT

An apparatus for and method of drying agglomerated moist particulate material, the particles of which when dry have a very low density. Drying is effected by supporting the material on a screen within a retainer, and by applying heat to the material in contact with the screen by way of an electrical or heat exchange type heating element. Vaporized moisture is extracted by way of a vent which extends upwardly through the retainer from a position adjacent the screen, so that the vapour is caused firstly to flow down through the screen and then upwardly through the vent.

4 Claims, 2 Drawing Figures

METHOD OF AND APPARATUS FOR DRYING PARTICULATE MATERIAL

FIELD OF THE INVENTION

This invention relates to a method of and apparatus for drying particulate material. The invention has been developed particularly for the drying of cenospheres and is herein described in this context, but it is to be understood that the invention may be applied to drying of other materials such as fine sand.

BACKGROUND OF THE INVENTION

Cenospheres are hollow spherical-form particles which are contained in fly ash. They have a white to light grey colour, are composed predominantly of silica (59%), alumina (28%) and iron oxide (5%), contain mainly nitrogen within the sphere, have a size from 45 to 150 micrometers, a specific gravity of 0.55 and a dry density (less than 0.5% moisture) of 330 $Kg/m^3$. The cenospheres have application as aggregate for lightweight concrete and are suitable for use in refractories, plastics materials, paints, sound insulation material, general filler applications and thermal insulating materials.

The cenospheres are separated from the other constituents of fly ash by water flotation processes but subsequent drying of agglomerated cenosphere material has been found to be extremely difficult, using conventional drying apparatus, due to the low density of the material.

SUMMARY OF FIRST ASPECT OF THE INVENTION

The present invention seeks to avoid this difficulty by providing a drying apparatus comprising a retainer for moist particulate material, a screen located within the retainer and arranged to support the material when loaded into the retainer, means for extracting moisture from material located adjacent the screen, and means for vibrating the retainer whereby the material when at least partially dried is induced to flow through the screen. The means for extracting moisture comprises at least one heater element which is disposed in or adjacent the screen and a vent which extends upwardly from a position adjacent the screen.

The screen has a mesh size which is sufficiently large to pass the material in its dried or partially dried condition but which is not so large as to pass the material in its moist (agglomerate) state. A 1200 micrometer mesh screen has been found suitable for use in the apparatus when employed for drying cenospheres.

PREFERRED FEATURES OF THE INVENTION

The heater element may comprise an electrical heating element or a heat exchange type of heating element that employs, for example, hot fluid (liquid or gas) as a heating medium. However, the term "heater element" is to be understood in the context of this specification as excluding a burner that produces heat by combustion in the region of the screen and which would thereby cause a gas draft which would tend to carry dried material up the vent.

When the heater element comprises an electrical heating element, it may be embodied in the screen or it may be mounted in heat exchanging relationship with the screen.

The vibrator is preferably arranged to be energized periodically, but it may be energized continuously. The frequency and amplitude of vibration, the period between successive energizations of the vibrator, the period of vibration, the mesh size of the screen and the moisture extraction rate are all, at least to a certain extent, dependent variables and the best combination of these factors must be determined empirically for different types of material to be dried.

SUMMARY OF SECOND ASPECT OF THE INVENTION

As well as providing an apparatus, the present invention may be defined as providing also a method of drying moist agglomerated particulate material, the method comprising loading the material into a retainer and supporting the material upon a screen within the retainer, extracting moisture from the material whilst supported on the screen and vibrating the retainer. Vibration of the retainer may be effected either continuously or at periodic intervals of time. The moisture extraction is effected by applying heat to the material from at least one heating element that is disposed in or adjacent the screen and by venting liberated vapour through a vent which extends upwardly from a position adjacent the screen.

The invention will be more fully understood from the following description of a preferred embodiment of an apparatus, which is suitable for use in the drying of cenospheres, as shown in the accompanying drawing.

DETAILED DESCRIPTION OF THE INVENTION

Figure 1:
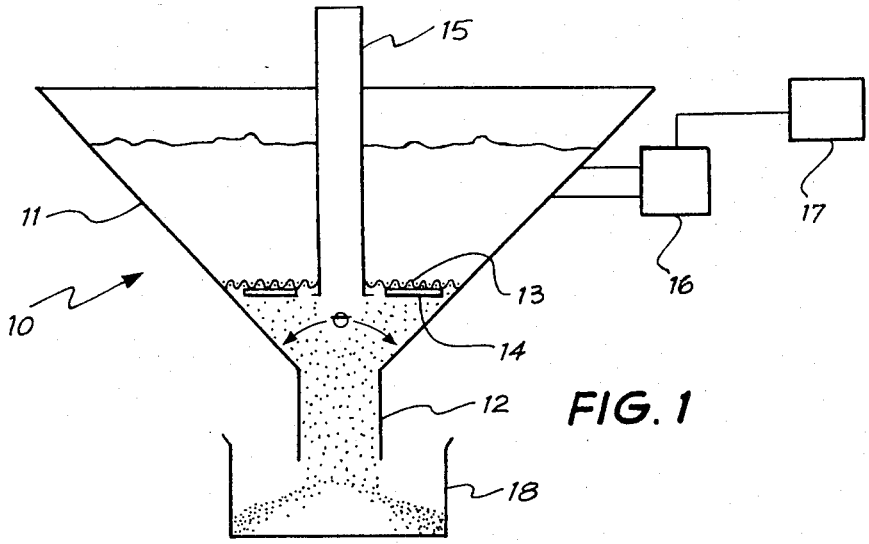
FIG. 1 shows a sectional elevation view of the drying apparatus.
Figure 2:
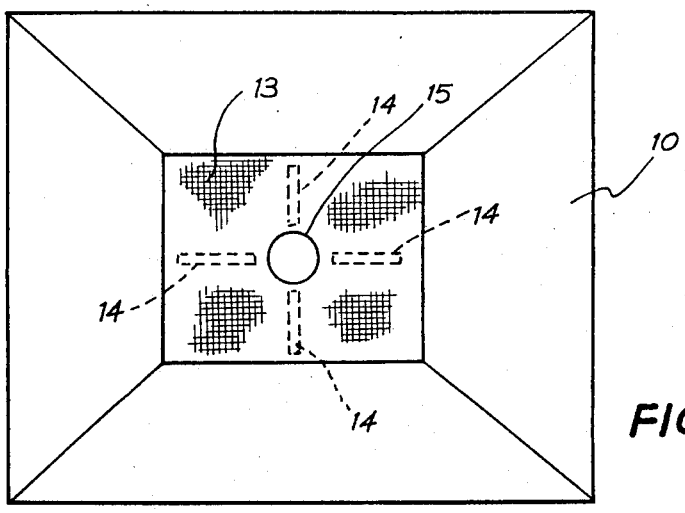
FIG. 2 shows a plan view of a retainer portion of the apparatus.

As shown, the apparatus comprises an inverted square-pyramidal-form retainer 10 into which moist cenospheres are loaded following their separation, by a flotation process, from fly ash. The walls 11 of the retainer define an included angle $\theta$ of approximately 90°, and the walls join a lower cylindrical outlet 12.

Located within the retainer is a screen in the form of a stainless steel mesh 13 (mesh size 1200 micrometers) which is arranged to support the material loaded into the retainer.

Four radially projecting electric heaters 14 are mounted to and in direct contact with the underside of the screen 13. The heaters each comprise a steel sleeved silica element.

A vent 15 rises from the underside of the screen 13 and projects above the level of the retainer, for removing water vapour generated by heating of the material by the elements 14.

A vibrator 16 is mounted to the retainer and is electrically energized by way of a controller 17. The controller is set to provide actuation of the vibrator at hourly intervals and for a period of 45 seconds.

In a typical drying apparatus of the type above described, the screen 13 is approximately 1.2 meters square and is located 0.75 meters below the rim of the retainer 10. The vent 15 has an internal diameter of 10 centimeters and has a total length of 1.05 meters, so that it projects above the rim of the retainer by a distance of approximately 0.3 meters. Each of the heaters has a heating capacity of 1.0 kilowatt, making a total heating capacity of 4.0 kilowatts.

In operation of the apparatus, dried cenospheres pass through the screen 13 and fall into collecting bins 18, movement of the dried material being induced by vibration of the retainer.

Drying of the cenospheres is effected by applying heat from the elements 14 to the screen 13 and hence to the material that lies adjacent the screen. The applied heat causes vaporisation of moisture in the material and liberated vapour tends to follow the path of least resistance by first moving downwards through the screen and into the zone of the retainer below the screen. Thereafter, the vapour rises and passes from the retainer by way of the vent 15.

The length of the vent is kept relatively short for two reasons. Firstly, to prevent the occurrence of a significant chimney affect which would produce an upward gas flow velocity of a magnitude sufficient to cause cenosphere entrainment and extraction, and secondly to militate against condensation within the vent of vapour that passes upwardly from the retainer.

We claim:

1. A method of drying moist agglomerated particulate material utilizing a retainer having a screen, comprising:

loading the material into said retainer and supporting the material upon said screen within the retainer; and extracting moisture from the material directly from the underside of said screen while said material is supported on the screen, the moisture extraction being effected by applying heat to the material in the zone of the screen;

venting the vapour liberated from said material upwardly from a position adjacent the screen;

and vibrating the retainer whereby the at least partially dried material flows downwardly through said screen.

2. A method as claimed in claim 1, wherein the venting takes place through a vapour receiving opening immediately below the underside of the screen so that the liberated vapour is induced to flow downwardly through the screen before said venting.

3. A method as claimed in claim 2, wherein the the vibration occurs for a predetermined duration at periodic time intervals.

4. A drying apparatus for a low density moist particulate material, said apparatus comprising:

a retainer for retaining moist particulate material that is to be dried;

a screen located within the retainer and arranged to support the moist material when loaded into the retainer;

heater means for extracting moisture from moist material located within the retainer adjacent the screen, with said moisture moving downwardly through said screen;

means for vibrating the retainer whereby the material when at least partially dried is induced to flow downwardly through the screen; and a vent which extends upwardly from a position adjacent the screen through which the moisture extracted by said heater means passes upwardly, said vent comprising a tube that extends upwardly through the retainer from a position immediately below the underside of said screen.

* * * * *